US008967061B2

(12) United States Patent
Weiss

(10) Patent No.: US 8,967,061 B2
(45) Date of Patent: Mar. 3, 2015

(54) METHOD AND APPARATUS FOR THREAD-STITCHING OF BOOK BLOCKS, AND A BOOK PRODUCTION LINE EQUIPPED WITH SUCH AN APPARATUS

(71) Applicant: Mueller Martini Holding AG, Hergiswil (CH)

(72) Inventor: Marcel Weiss, Bad Mergentheim (DE)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 13/859,299

(22) Filed: Apr. 9, 2013

(65) Prior Publication Data

US 2013/0263768 A1 Oct. 10, 2013

(30) Foreign Application Priority Data

Apr. 10, 2012 (CH) ..... 0495/12

(51) Int. Cl.

| | |
|---|---|
| ***D05B 47/00*** | (2006.01) |
| ***B42B 2/02*** | (2006.01) |
| ***D05B 47/04*** | (2006.01) |
| ***B65H 57/12*** | (2006.01) |
| ***B65H 59/26*** | (2006.01) |
| *D05B 23/00* | (2006.01) |

(52) U.S. Cl.

CPC . *B42B 2/02* (2013.01); *D05B 47/04* (2013.01); *B65H 57/12* (2013.01); *B65H 59/26* (2013.01)

USPC ..... 112/475.08; 112/21

(58) Field of Classification Search

USPC ..... 112/21, 22, 254, 255, 302, 475.01, 112/475.08, 475.17; 412/1, 6, 7, 33, 35

See application file for complete search history.

(56) References Cited

U.S. PATENT DOCUMENTS

| | | | | |
|---|---|---|---|---|
| 89,489 | A * | 4/1869 | Lyon | 112/245 |
| 2,746,410 | A * | 5/1956 | Passons | 112/254 |
| 3,009,433 | A * | 11/1961 | Kuhn | 112/273 |
| 3,140,682 | A * | 7/1964 | Hale et al. | 112/242 |
| 3,762,346 | A * | 10/1973 | Cobble | 112/80.44 |
| 4,041,883 | A * | 8/1977 | Meratti | 112/21 |
| 4,252,071 | A * | 2/1981 | Rathert et al. | 112/21 |
| 5,345,887 | A * | 9/1994 | Droste | 112/255 |
| 5,404,824 | A * | 4/1995 | Hiraoka et al. | 112/254 |
| 5,887,532 | A * | 3/1999 | Hollenstein et al. | 112/21 |
| 6,390,748 | B2 * | 5/2002 | Stolz | 412/35 |

FOREIGN PATENT DOCUMENTS

EP 1155872 11/2001

OTHER PUBLICATIONS

International Search Report of CH 4952012 Dated Jul. 4, 2012 With English Translation.

* cited by examiner

*Primary Examiner* — Ismael Izaguirre

(74) *Attorney, Agent, or Firm* — Venable LLP; Robert Kinberg

(57) ABSTRACT

An apparatus for thread-stitching a book block includes a thread tensioning device configured to store and tension a binding thread. A single actuator, including a servo drive, drives the thread tensioning device. The method includes storing a length of binding thread; in a separate step, tensioning the binding thread; and thread-stitching the book block.

7 Claims, 4 Drawing Sheets

METHOD AND APPARATUS FOR THREAD-STITCHING OF BOOK BLOCKS, AND A BOOK PRODUCTION LINE EQUIPPED WITH SUCH AN APPARATUS

CROSS-REFERENCE TO RELATED APPLICATION

This application claims the priority of Swiss Patent Application No. 00495/12, filed on Apr. 10, 2012, the subject matter of which is incorporated herein by reference.

BACKGROUND OF THE INVENTION

The invention relates to a method for thread-stitching of book blocks, in particular, thread-stitching with blast air, including steps of storing a length of binding thread, tensioning the binding thread and thread-stitching a book block. The invention additionally relates to a corresponding apparatus for thread-stitching, including a thread tensioning device, wherein a binding thread can be stored and tensioned with a thread tensioning device. Further, the invention relates to a book production line equipped with such an apparatus.

A device for pulling a binding thread into a transfer section between a thread spool and a sewing needle is known from the European patent document EP 1155872 A1. With this device, which is embodied as a component of a thread-stitching machine, a binding thread needed for the stitching operation is first unwound from a spool and is then guided with the aid of different handling devices to a sewing needle and is then used to thread-stitch a book block. The handling devices comprise a plurality of conveying lines through which the binding thread is respectively conveyed, respectively with the aid of blast air. Two of these handling devices involve a thread-clamping device and a thread-tensioning device.

Furthermore known are devices for pulling a binding thread into a transfer section between a thread spool and a sewing needle which can operate without using blast air.

The applicant's own thread-stitching machine sold under the trade name Ventura comprises a thread-clamping device as well as a thread-tensioning device. The thread-clamping device includes two discs, wherein one of these discs is attached to a bolt while the other disc is positioned so that on the bolt it can be displaced in an axial direction with the aid of a spring. Between these discs, a through opening is provided in the bolt, at a right angle to the bolt axis, through which the binding thread is guided. The discs are pressed together with spring pressure, wherein the binding thread is correspondingly released or held in place by activating a pneumatic cylinder that is connected to the bolt.

The thread-tensioning device comprises a mechanically driven tubular shaft, which is positioned to rotate, through which several axially spaced-apart tubes are fitted while arranged at a right angle to a shaft axis. A binding thread is guided through each of these tubes. By rotating the tubular shaft, the pull on the binding threads increases proportionally to how much an angle between the tubes increases relative to a thread direction which is not deflected. With an opened thread-clamping device, the thread-tensioning device will store a specific length of the binding thread moving through a tube for the stitching process by unwinding the respective binding thread from the spool through a rotation of the tubular shaft. With a closed thread-clamping device, an already stitched book block is tensioned through a further rotation of the tubular shaft prior to the stitching operation. With an additional rotation of the tubular shaft while the thread-clamping device is closed, a just stitched sheet is tensioned against a growing book block.

In this or a similar manner, known apparatuses for producing thread-stitched book blocks successively produce thread-stitched book blocks composed of several parts during a cyclic operation. Within a cyclic operation assigned to a book block, the thread-stitching device operates with sewing cycles per se, wherein one sewing cycle comprises angles ranging from 0° to 360°.

The diagram shown in FIG. 4 illustrates the course of a thread tensioning operation during these sewing cycles. The thread tensioning follows from the course of a rotational angle, plotted on the y-axis above the cycle angle shown on the x-axis. This rotational angle course results from an actuation of the tubular shaft via a cam drive, not shown herein, which always has the same movement characteristic and can intervene only to a limited degree in case of deflections.

Overlapping the sewing cycles, a specific binding thread length for the following sewing cycle is stored in a cycle angle range from 300° to 90° when the thread-clamping device is open. Once the thread-clamping device closes at approximately 90°, it remains closed until the cycle angle reaches approximately 120°, whereupon a thread stitch carried out during the preceding cycle is tensioned further by rotating the tubular shaft at a rotational angle of approximately 25° to −40°, which is followed by the stitching operation for an additional stitch. Up to the cycle angle of 250°, the binding thread continues to be fed to the needle for a stitching movement by further rotating the tubular shaft, which is then following by a subsequent tensioning of the additional stitch up to approximately 300° cycle angle.

Resulting therefrom are characteristic curves for the known method according to FIG. 4 which show that of necessity a large amount of binding thread is stored with high thread tension. A maximum adjustment results in a characteristic curve drawn with short dashes while a minimum adjustment of a mechanical superimposed gear with cam control for the rotation of the tubular shaft results in a characteristic curve drawn with longer dashes. FIG. 4 shows that essentially only a parallel displacement of the respective characteristic curve takes place between the maximum and the minimum adjustment.

The assumption is that thread-stitching machines provided with the known thread-tensioning devices are used only for the processing of medium or large book editions for which all book blocks are identically composed.

When producing micro-editions of books, for example personal photo albums, each book block must be considered a unique item. For that reason, each individual book block must meet standard qualification criteria, for example relating to the thread tension for the binding threads which combine the individual parts of a book block. Accordingly, the requirements for such micro-editions are different with respect to the tensioning of the binding thread, meaning that more flexible characteristics are required when changing between different, successively following production orders, wherein these requirements can be met only insufficiently by the solutions offered in the prior art.

Notwithstanding the above, the use of servo drives is known for cases where an electronically controlled drive is needed which meets special requirements for the dynamic, the control range and/or the accuracy of a movement.

For the aforementioned application, however, an electronic control is not required and would be unnecessarily expensive since book blocks can be produced securely in a process requiring few and seldom needed adjustments of the thread-tensioning devices with the above-described, improved mechanical superimposed gears, which have been tested over long periods of time. Even during the changeover between different book editions, the known thread-tensioning devices are rarely adjusted.

SUMMARY OF THE INVENTION

It is therefore an object of the present invention to provide an apparatus and a method for producing thread-stitched book blocks which meet the requirements of micro editions, in particular for use with a thread-stitching operation using blast air.

According to an embodiment of the invention, there is provided a method for thread-stitching a book block, comprising: storing a length of binding thread; in a separate step, tensioning the binding thread; and thread-stitching the book block.

According to a another embodiment of the invention, there is provided an apparatus for thread-stitching a book block, comprising: a thread tensioning device configured to store and tension a binding thread; and a single actuator comprising a servo drive to drive the thread tensioning device.

According to yet another embodiment of the invention, there is provided a book production line including such an apparatus.

The invention is based on a finding that in view of a fast production changeover, it is advantageous if the thread store and the thread tensioning can be adjusted separately. An adjustment of this type makes it possible to process a variety of sheets which differ in thickness and material to form a single book block. Based on this finding and depending on the post-processing requirements, the individual book blocks can be embodied differently, for example with a varying number of sheets in each book block.

The device for the thread-stitching of book blocks, in particular for the thread-stitching with blast air, comprises a thread-tensioning device, which is driven with the aid of a single actuator embodied as servo drive that functions to store and tension a binding thread. A precise positioning of movable control elements is thus possible, and existing apparatuses can be retrofitted cost-effectively.

According to one embodiment of the apparatus, the thread-tensioning device includes a tubular shaft which rotates around a shaft axis. Several small tubes through which respectively one binding thread runs may be arranged axially spaced apart in the tubular shaft, at a right angle to the shaft axis.

The tubular shaft can be activated with the aid of the servo drive, depending on the requirements for the thread-stitching, wherein all binding threads guided through the small tubes in the tubular shaft can be stored and tensioned jointly with the aid of the single servo motor.

The apparatus may be used as component of a book production line.

The method for producing thread-stitched book blocks, in particular for the thread-stitching with blast air, comprises the method steps of storing a length of a binding thread, tensioning the binding thread and thread-stitching a book block. In the process, the method steps of storing a length of binding thread and tensioning the binding thread are carried out separately.

In one embodiment of the method, a single actuator with therein stored different values specified for the storage and tensioning of the binding thread is activated in order to store a length of binding thread and for tensioning the binding thread. In this embodiment, a continuous adjustment of the thread-tensioning device and thus also an optimization of the method may be possible during the operation at full speed of the thread-stitching machine. In addition, the thread store and the thread tensioning can be adjusted separately, thus making it possible to process different types of print sheets during a work order and to realize additional movements for special functions, for example block separation.

According to another embodiment of the method, a single tubular shaft may be rotated around a shaft axis for storing the thread and for tensioning the thread. As a result, a controllable running of the binding thread can be realized in each small tube arranged in the tubular shaft, without loop forming, overstretching or thread breakage.

BRIEF DESCRIPTION OF THE DRAWINGS

These and other features and advantages of the invention will be further understood from the following detailed description with reference to the accompanying, drawings.

DETAILED DESCRIPTION

Figure 1:
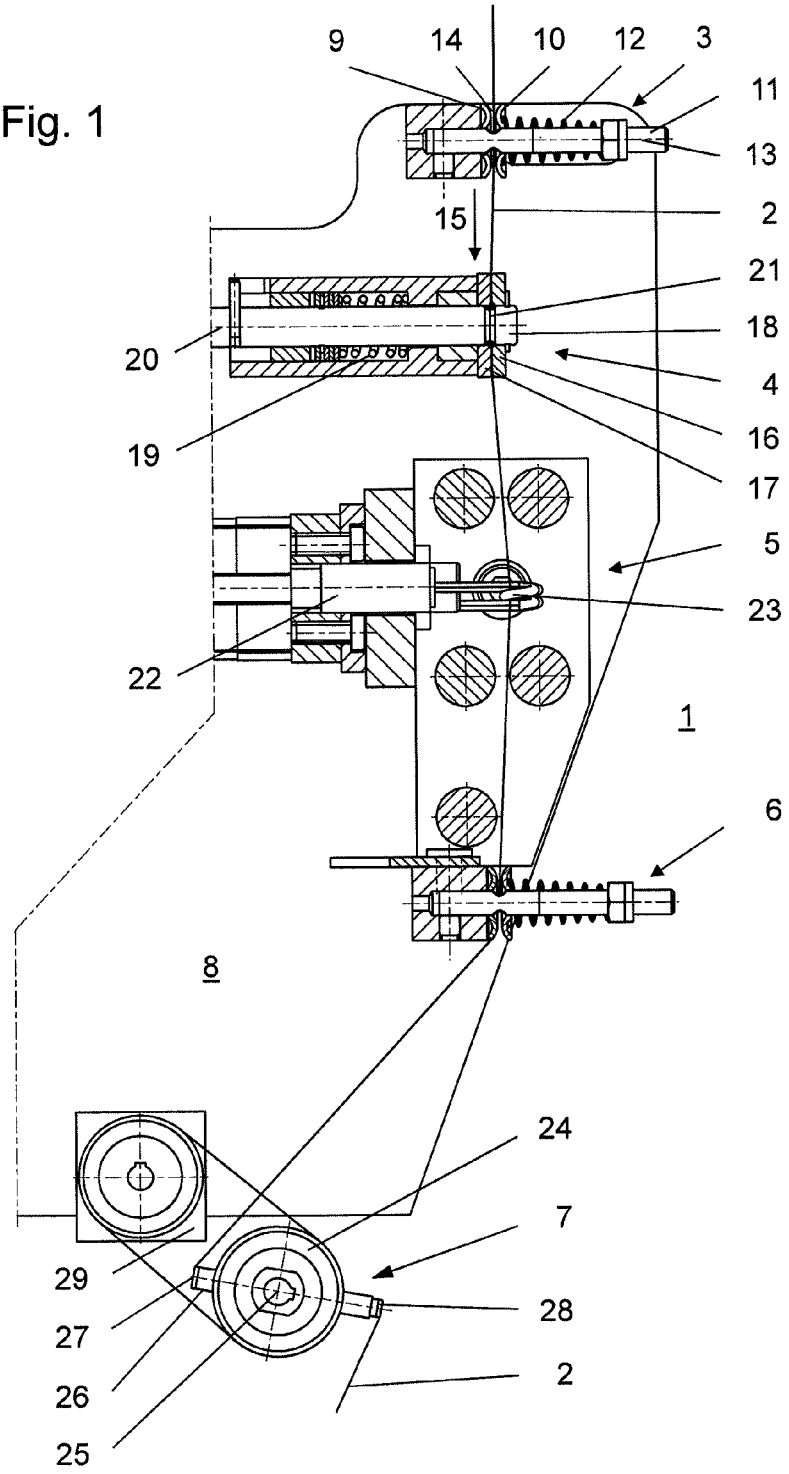
FIG. 1 shows a view from the side of a transfer section for a binding thread on an apparatus for the thread-stitching of book blocks, comprising two thread brakes, a thread clamping device, a thread-compensation device and a thread-tensioning device which is in a neutral position and is equipped with a tubular shaft.

FIG. 1 shows an embodiment of a transfer section 1 for a binding thread 2, arranged between a thread spool that is not shown herein and a sewing needle on a thread-stitching machine which is also not shown herein, comprising a first thread brake 3, a thread-clamping device 4, a thread-compensation device 5 in a neutral position, a second thread brake 6 and a thread-tensioning device 7 which is also shown in the neutral position. The thread-stitching machine, shown herein only with a machine frame 8, is embodied with several essentially side-by-side arranged transfer sections 1, in dependence on the thickness of the book block to be produced, meaning based on the number of printed sheets and/or individual pages to be combined into a book block. The components belonging to the transfer sections 1 are respectively attached to the machine frame 8 of the thread-stitching machine. In the following, the arrangement and joint operation of the components for a single transfer section 1 are discussed in simple terms with an example.

The two thread brakes 3 and 6 are provided with a first and a second disc 9 and 10. The first disc 9 is attached to a pin 11 while the second disc 10 is positioned on the pin 11 to be axially displaceable with the aid of a spring 12. Between the discs 9, 10, the pin 11 contains an opening 14 through which the binding thread 2 is guided and which is arranged at a right angle to an axis 13 of the pin 11. The size of this through opening 14 is fixed via the spring force, The thread clamping device 4, arranged in thread-movement direction 15 between the first and the second thread brakes 3 and 6, is also provided with a first and a second disc 16 and 17. The first disc 16 is attached to a bolt 18 while the second disc 17 is positioned on the bolt 18 to be axially displaceable with a spring 19. Between the discs 16 and 17, the bolt 18 contains a through opening 21 positioned at a right angle to an axis 20 of the bolt 18, through which the binding thread 2 is guided. The discs 16, 17 are pressed together by the pressure of a spring, wherein the binding thread 2, for example, is correspondingly released or held in place by activating a pneumatic cylinder, not shown herein, which is connected to the bolt.

The thread compensation device 5, which is also arranged between the first and the second thread brake 3, 6 and after the thread clamping device 4, as seen in the thread movement direction 15, comprises a linear displaceable eyelet 23 that is connected, for example, to a rod 22 of a pneumatic cylinder which is not shown herein. This eyelet 23 can be used for a work order requiring offset stitching, for which the position of the binding thread 2 is offset by one stitch length (so-called alternating stitch). For this, the binding thread 2 in the first and the last sewing needle of the thread-stitching machine is threaded into the eyelet 23 of the respective thread compensation device 5. Thus, if the binding thread 2 in the outer left sewing needle of the thread-stitching machine is blown by the effect of the blast air to the left during the actual work of the thread-stitching machine is blown by the effect of the blast air to the left during the actual work cycle, no hook needle is available at that location which takes up the loop formed and cooperates with this sewing needle. For that reason, the eyelet 23 is extended in the linear direction at this instant and, in the process, pulls back the binding thread 2. With respect to the following cycle, the excess binding thread 2 is thus compensated for and the book block can be stitched. In the cycle following the next cycle, the binding thread 2 is again blown with the blast air toward the left, so that the eyelet 23 must again be extended to compensate for the excess binding thread 2. The same identical operation takes place on the right side of the book block if the binding thread 2 of the outer right sewing needle is blown to the right by the effect of the blast air, thereby forming a loop, which cannot be taken up by a hook needle. In this manner, the thread tension of the two outer sewing needles on the thread-stitching machine is compensated for with the aid of the thread compensation device 5.

Figure 6:
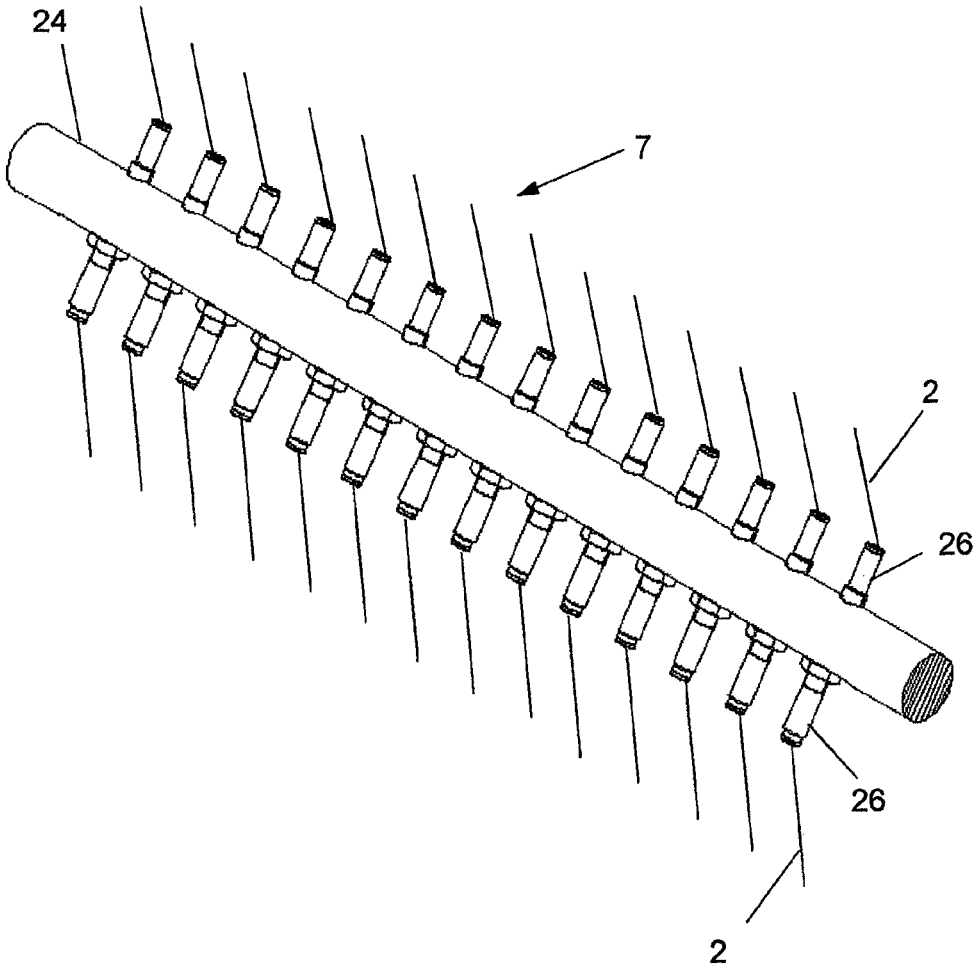
FIG. 6 shows a perspective view of the tubular shaft of the thread tensioning device.

The thread tensioning device 7, arranged following the second thread brake 6 as seen in the thread movement direction 15, comprises a tubular shaft 24 through which a number of small tubes 26 extend, crosswise to a shaft axis 25, wherein the number of small tubes depends on the machine configuration. A separate binding thread 2 runs through each of the small tubes 26 which are designed to redirect this binding thread 2 from a feed direction to a removal direction that differs from the feed direction. For this purpose, the small tubes are respectively provided with an input side opening and an output side opening 27, 28 for the binding thread 2. The small tubes 26 of the side-by-side arranged thread tensioning devices 7 of the thread-stitching machine are arranged successively, one behind the other, in axial direction of the tubular shaft 24, as shown in FIG. 6, so that only one small tube 26 is visible in the representations shown in FIGS. 1 to 3. The tubular shaft 24 is connected to an actuator 29, embodied as servo drive, and is also attached to the machine frame 8, for generating a rotational movement of the tubular shaft 24 around its shaft axis 25.

Figure 2:
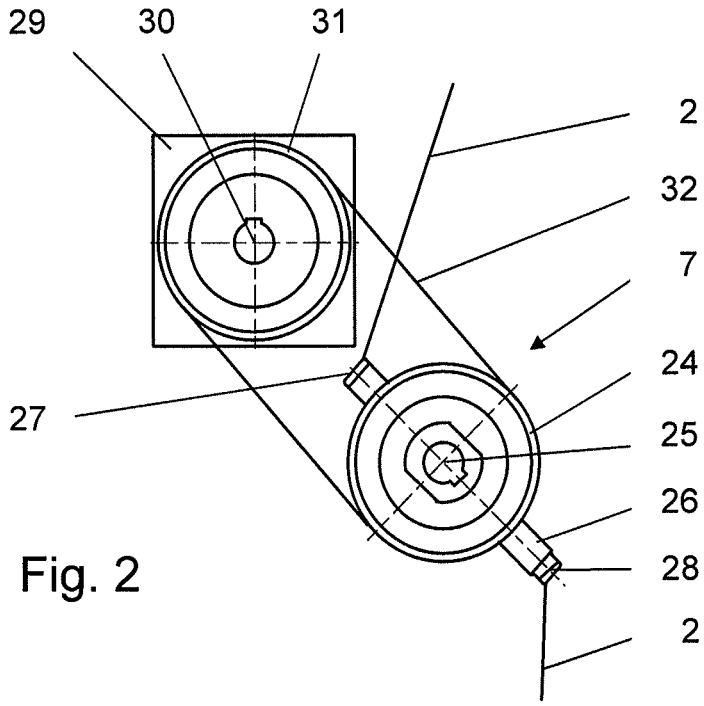
FIG. 2 is an enlarged, schematic representation as compared to FIG. 1 of the thread-tensioning device, but shown in a stitching position.

As compared to FIG. 1, FIG. 2 shows an enlarged, schematic representation of a thread tensioning device 7, which is in a thread storing position, in which position the small tubes 26 may be rotated clockwise by an angle of approximately 45°, relative to a neutral position, around the shaft axis 25 of the tubular shaft 24. In the process, the input side openings 27 of the small tubes 26 are moved in the direction of the second thread brake 6. The rotational movement is realized with a pulley 31 that is arranged on a drive shaft 30 of the actuator 29, wherein this pulley is connected via a toothed belt 32 to the tubular shaft 24. Of course, any other suitable connection can also be established between the actuator 29 and the tubular shaft 24.

As a result of the rotational movement of the small tube 26, the binding thread 2 is deflected slightly as compared to the neutral position and a specific length of the binding thread 2 is thus stored for a sewing needle stitch to be punched through the book block. This stored binding thread 2 can be used during the following thread-stitching operation, for example using the blast air method known from European patent document EP 0832758 A2, for generating a loop that is not shown herein with the binding thread 2.

Figure 3:
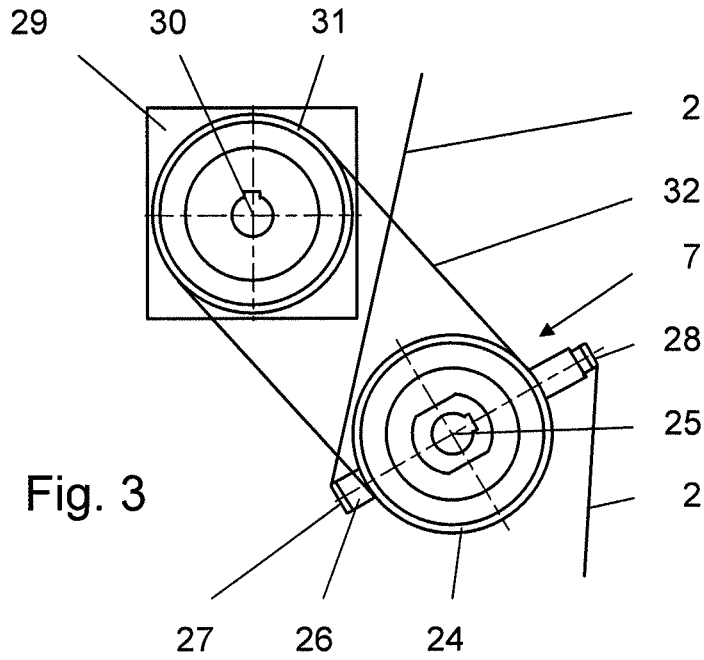
FIG. 3 is an enlarged, schematic representation as compared to FIG. 1 of the thread-tensioning device, but shown in a tensioning position.

FIG. 3 shows an enlarged, schematic representation, as compared to FIG. 1, of the small tube 26 which is rotated in counter-clockwise direction by an angle of approximately 30° around the shaft axis 25 to a tensioned position, relative to the neutral position for the thread tensioning device 7. The input side opening 27 of the small tube 26 is thus moved away from the second thread brake 6, so that the binding thread 2 is tensioned.

In principle, it is not important either for the storage position or the tensioning position whether the thread tensioning device 7, meaning its tubular shaft 24, is rotated in clockwise or in counter-clockwise direction. Rather, it is the degree of deflection of the small tubes 26 and/or the therein guided binding thread 2 from the neutral position of the tubular shaft 24, which is decisive for the function.

Depending on the requirements of the book block for binding, the actuator 29 controls the required amount of binding thread 2 via the rotational movement of the tubular shaft 24, wherein the stored binding thread 2 and the degree of the deflection of the small tubes 26 and/or the binding thread 2 guided therein can be adjusted separately.

Figure 4:
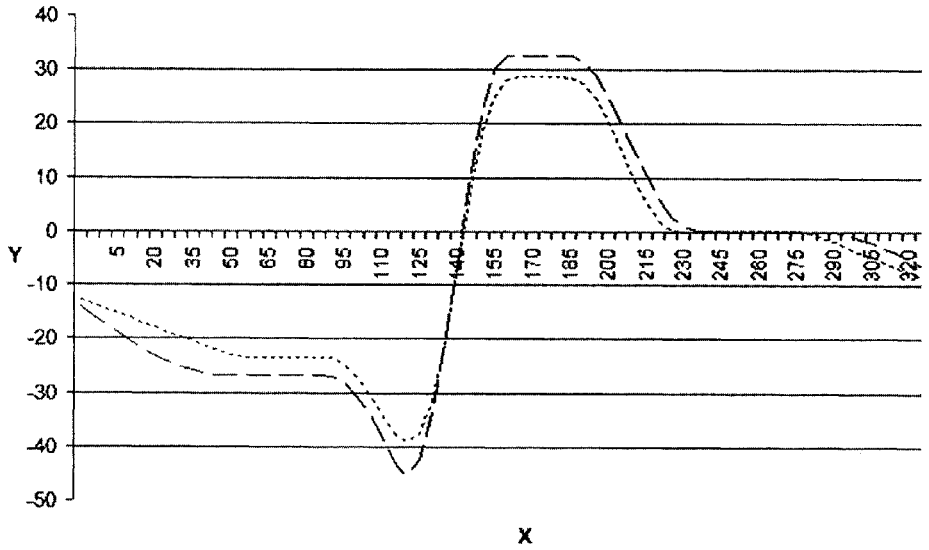
FIG. 4 *a* shows a cycle angle/rotational angle diagram for illustrating the course of thread tensioning for a minimum and/or a maximum adjustment, using a known thread-tensioning device.
Figure 5:
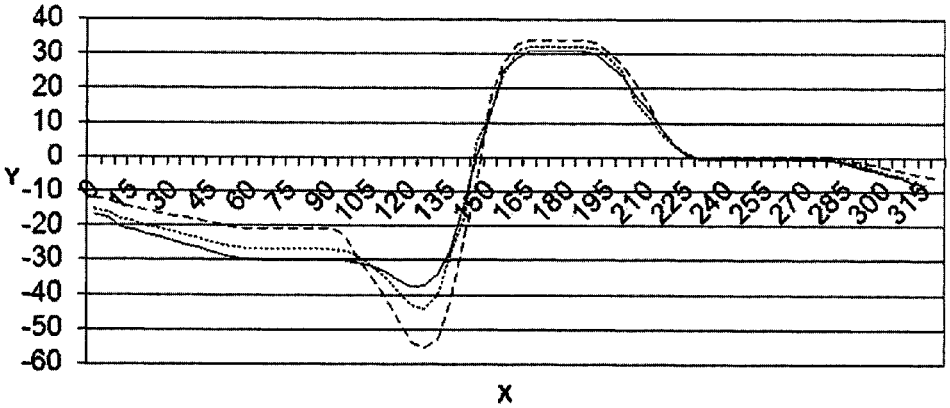
FIG. 5 shows a cycle angle/rotational angle diagram for illustrating the course of a thread tensioning with a minimum and/or maximum adjustment, using a thread-tensioning device according to the invention.

The diagram in FIG. 5 illustrates the course of the thread tensioning operation when using the thread tensioning device 7 according to the invention. By using an actuator 29 that is embodied as servo motor, optional curve courses can be generated, as compared to the prior art shown in FIG. 4. The thread tensioning and the thread storage for different products, different types of thread, different needle designs and other machine parameters can thus be adapted completely separately. Various curve courses with different requirements are described in the following.

The dashed line shows a slight deflection in a cycle angle ranging from 300-65°, meaning relatively little binding thread 2 is stored. A relatively large deflection of the binding thread 2 can be detected at 120° for the cycle angle and thus a lot of tension in the already stitched book block. During the stitching taking place at a cycle angle range between 150° and 300°, the course of the curve for the stitching is nearly the same as for the standard setting. This type of curve course is suitable for extremely smooth book blocks composed of stable or relatively thin paper, for which the thickness is less than for a book block formed with the standard setting.

The dotted line represents the standard setting for book blocks which are used most often and shows a larger deflection in the cycle angle, ranging from 300-65°, meaning that more binding thread 2 is stored than with the previously described dashed line. In addition, a comparatively lower tensioning movement results for the cycle angle of 120°.

The continuous line shows a relatively large thread store and a low tension movement at a cycle angle of 120°. This curve course is used for thick folding sheets and allows producing a thicker, but loose book block.

As compared to the two curve courses shown in FIG. 4, which represent options for the prior art, FIG. 5 shows a considerably higher variability for possible curve courses, with separate operations for the storing and tensioning of the binding thread, for example when driving the thread tensioning device 7 with the aid of an actuator 29, especially a servo drive.

It will be understood that the above description of the present invention is susceptible to various modifications, changes and adaptations, and the same are intended to be comprehended within the meaning and range of equivalents of the appended claims.

What is claimed is:

1. A method for thread-stitching a book block, comprising:

storing a length of binding thread by rotating a single tubular shaft, a shaft axis, about the shaft axis;

in a separate step from the storing, tensioning the binding thread by rotating the single tubular shaft about the shaft axis; and thread-stitching the book block.

2. The method according to claim 1, including actuating a single actuator with respectively different specified values for rotating the single tubular shaft in order to store a length of binding thread and for tensioning the binding thread.

3. An apparatus for thread-stitching a book block, comprising:

a thread tensioning device including a single tubular shaft having a shaft axis, the single tubular shaft being rotatable about the shaft axis to store and tension a binding thread running, through the single tubular shaft crosswise to the shaft axis of the single tubular shaft; and a single actuator comprising a servo drive configured to drive the single tubular shaft to store or tension the binding thread.

4. The apparatus according to claim 3, including a plurality of small tubes arranged in the tubular shaft, spaced apart in an axial direction of the tubular shaft and at a right angle to the shaft axis, wherein one binding thread runs through each small tube.

5. A book production line equipped with an apparatus according to claim 3.

6. A method of operating a book production line, including utilizing the apparatus for thread-stitching a book block according to claim 3.

7. The method of claim 1, further including passing the binding thread through at least one tube extending crosswise to the shaft axis of the single tubular shaft.

* * * * *